US005179830A

United States Patent [19]

Donath

[11] Patent Number: 5,179,830

[45] Date of Patent: Jan. 19, 1993

[54] APPARATUS FOR CLEANING STRANDED CABLE

[75] Inventor: Steven M. Donath, Wayne County, Ill.

[73] Assignee: Southwire Company, Carrollton, Ga.

[21] Appl. No.: 661,941

[22] Filed: Feb. 28, 1991

[51] Int. Cl.[5] ..... D01H 11/00; A47L 5/38; A47L 5/14

[52] U.S. Cl. ..... 57/305; 15/309.1; 15/345; 57/138

[58] Field of Search ..... 57/138, 303–305, 57/314, 309; 28/222; 15/309.1, 345

[56] References Cited

U.S. PATENT DOCUMENTS

| | | | |
|---|---|---|---|
| 2,563,986 | 8/1951 | Bauer | 57/305 X |
| 2,597,801 | 5/1952 | Jellinek | 15/309.1 |
| 2,661,588 | 12/1953 | Griset | 57/305 X |
| 2,720,475 | 10/1955 | Geiger | 57/138 |
| 3,041,905 | 7/1963 | Gabriel | 83/100 |
| 3,270,364 | 9/1966 | Steele | 15/309.1 |
| 3,593,395 | 7/1971 | Stanley | 28/222 X |
| 3,736,618 | 6/1973 | Ramsey | 15/309.1 |
| 3,778,862 | 12/1973 | Kesler | 15/309.1 |
| 3,956,790 | 5/1976 | Ishiwata et al. | 15/309.1 X |
| 4,248,035 | 2/1981 | Skillen et al. | 57/6 |
| 4,271,559 | 6/1981 | Blumenthal | 15/345 X |
| 4,322,944 | 4/1982 | Straitr et al. | 57/328 |
| 4,394,786 | 7/1983 | Stalson et al. | 15/309.1 |

FOREIGN PATENT DOCUMENTS

| | | | |
|---|---|---|---|
| 0723002 | 3/1980 | U.S.S.R. | 15/309.1 |

*Primary Examiner*—Daniel P. Stodola
*Assistant Examiner*—William Stryjewski
*Attorney, Agent, or Firm*—James W. Wallis, Jr.; Stanley L. Tate; George C. Myers, Jr.

[57] ABSTRACT

An apparatus for cleaning metal dust particles from a stranded cable made of metallic wires. The apparatus comprises a cleaning cylinder located downstream of a stranding die through which the stranded cable passes. Pressurized air is injected into the cleaning cylinder and impinges on the cable to entrain metal dust on the cable. A vacuum source connected to the cleaning cylinder withdraws air and entrained dust from the cleaning cylinder at a volumetric flow rate greater than the volumetric flow rate of pressurized air into the cleaning cylinder so as to generate a net inflow of air to the cylinder and prevent the egress of dust particles from the cylinder.

17 Claims, 2 Drawing Sheets

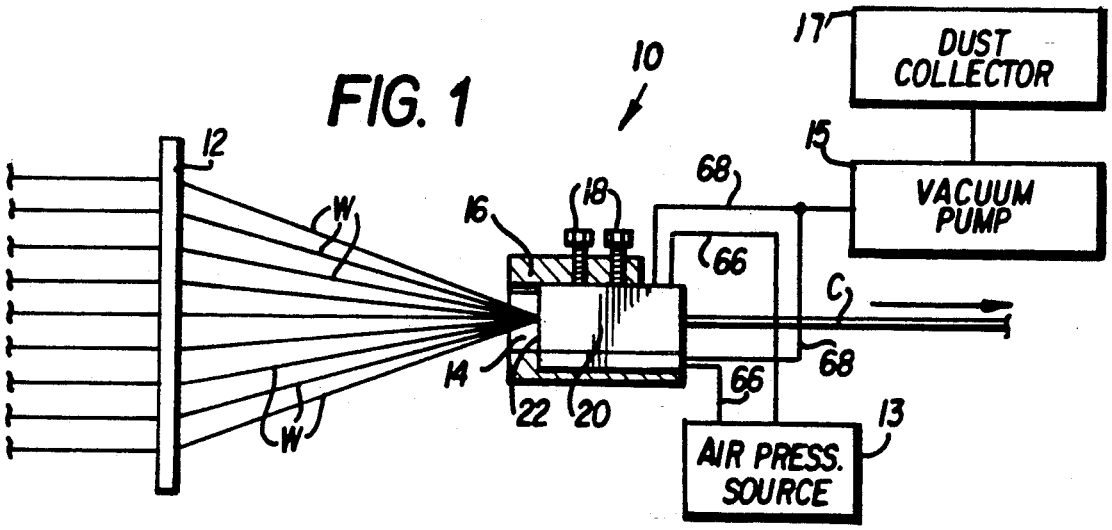
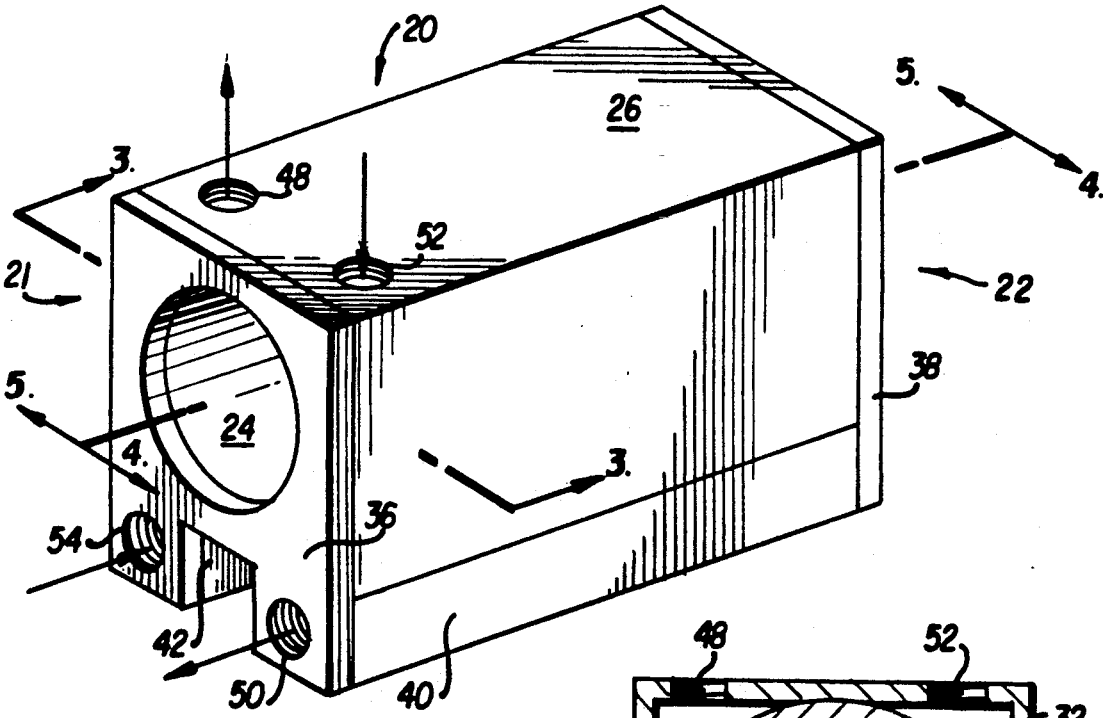
FIG. 2
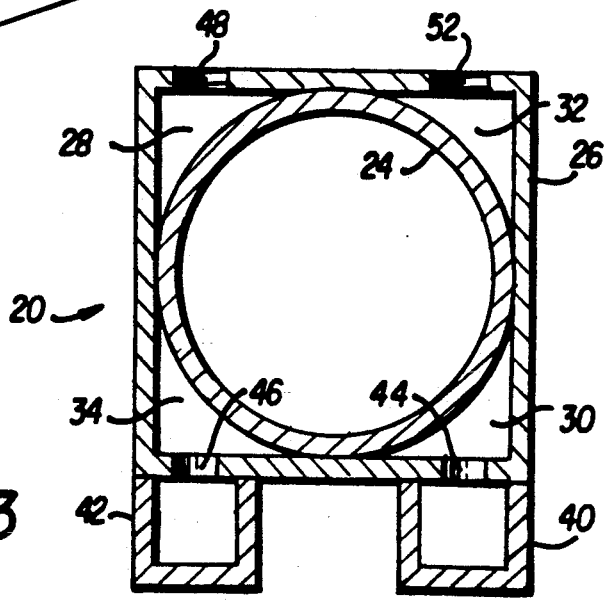
FIG. 3

APPARATUS FOR CLEANING STRANDED CABLE

FIELD OF THE INVENTION

The present invention relates to a wire stranding apparatus and, more particularly, to an in-line device for cleaning metal dust from a stranded wire cable and for recovering the metal dust as scrap for recycling.

BACKGROUND OF THE INVENTION

In the manufacture of metallic stranded wire cable, especially stranded cable made from copper and aluminum wire and alloys thereof, aluminum and copper metal dust is generated by the shaving action of the steel stranding die on the individual strands of wire. Heretofore, low pressure air has been directed across the cable downstream of the die to remove the dust prior to coiling the cable onto reels. While this technique is effective to clean the metal dust from the cable, it creates at least three problems in the manufacture of stranded cable. First, airborne metal dust particles can be a health hazard. Secondly, when the metal dust settles it can accumulate and, because it is electrically conductive, such accumulated dust can cause nuisance shutdowns of the stranding machine by activating the wire break detectors of the machine. Thirdly, the metal dust accumulates on the surfaces of the stranding machines and the plant floor surrounding the machines and must be periodically cleaned from those surfaces.

SUMMARY OF THE INVENTION

In view of the aforesaid shortcomings of the prior art technique for removing metal dust from stranded cable, it should be apparent that there still exists a need in the art for an apparatus for cleaning the metal dust from the cable before it becomes airborne. That objective is accomplished according to the apparatus of the present invention by providing a cable cleaning cylinder immediately downstream of the stranding die so that the die forms an upstream end closure for the cable cleaning cylinder and the stranded cable passes coaxially through the cylinder. The downstream end of the cylinder is open so as to admit the flow of external air. The cleaning cylinder is constructed with a pair of oppositely disposed pressure chambers or plenums and a pair of oppositely disposed vacuum chambers or plenums so that each pressure chamber is located approximately 90° from a respective vacuum chamber.

At the upstream end of the cleaning cylinder a plurality of holes or ports are provided in the cylinder wall which communicate with each pressure chamber so as to admit a plurality of air jets into the interior of the cylinder to impinge upon the surface of the stranded cable as it exits the stranding die. The velocity of the air jets is sufficient to clean the metal dust from the stranded cable and entrain or suspend the dust.

At the approximate longitudinal midpoint of the cleaning cylinder, a plurality of elongated openings or slots are provided in the cylinder wall which communicate with each vacuum chamber so as to withdraw the air and metal dust from the interior of the cleaning cylinder through the vacuum chamber and into a metal dust collector from which the metal dust, e.g., aluminum dust, may be removed and recycled as scrap aluminum.

Preferably, the volumetric outflow of air withdrawn from the interior of the cleaning cylinder through the vacuum chambers exceeds the volumetric inflow of air into the interior of the cleaning cylinder from the pressure chambers so that air is drawn by the vacuum from the surrounding atmosphere through the downstream, open end of the cleaning cylinder and into the vacuum chambers. This method of operating the cleaning cylinder insures that airborne metal dust from the cable does not exit the open end of the cleaning cylinder because an inflow of air into that end of the cylinder is maintained. Such inflow of air passes into the open end of the cylinder, entrains any airborne dust particles in its path, carries such dust particles through the elongated slots in the cylinder wall and into the vacuum chambers for collection and recycling.

With the foregoing and other features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 is a side elevation view, partly schematic, showing the stranded cable cleaning device arranged in-line with a stranding machine;

FIG. 2 is a perspective view of the stranded cable cleaning device of the present invention as viewed from the downstream end of the device;

FIG. 3 is a cross-sectional view of the cable cleaning device of the present invention taken along line 3—3 of FIG. 2;

DETAILED DESCRIPTION OF THE INVENTION

Figure 4:
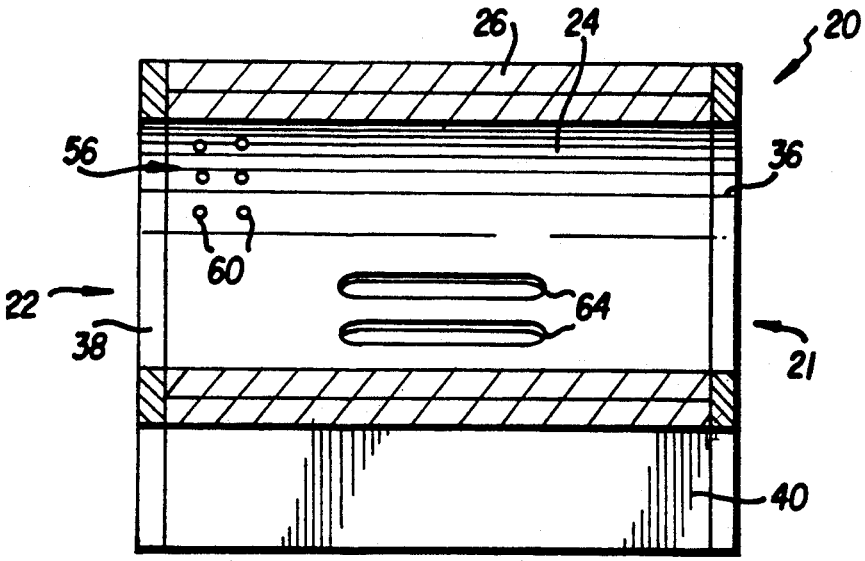
FIG. 4 is a cross-sectional view of the cable cleaning device of the present invention taken along line 4—4 of FIG. 2.

Referring now in detail to the drawings wherein like parts are designated by like reference numerals throughout, there is illustrated in FIG. 1, partly in schematic form, an in-line cable stranding apparatus designated generally by reference numeral 10. The apparatus 10 comprises a rotatable stranding head 12, through which pass a plurality of wires W to be stranded into a stranded cable C. The wires W are typically made of an electrically conductive metal, such as copper or aluminum or alloys thereof, however, other metals are contemplated within the scope of the invention.

Figure 6:
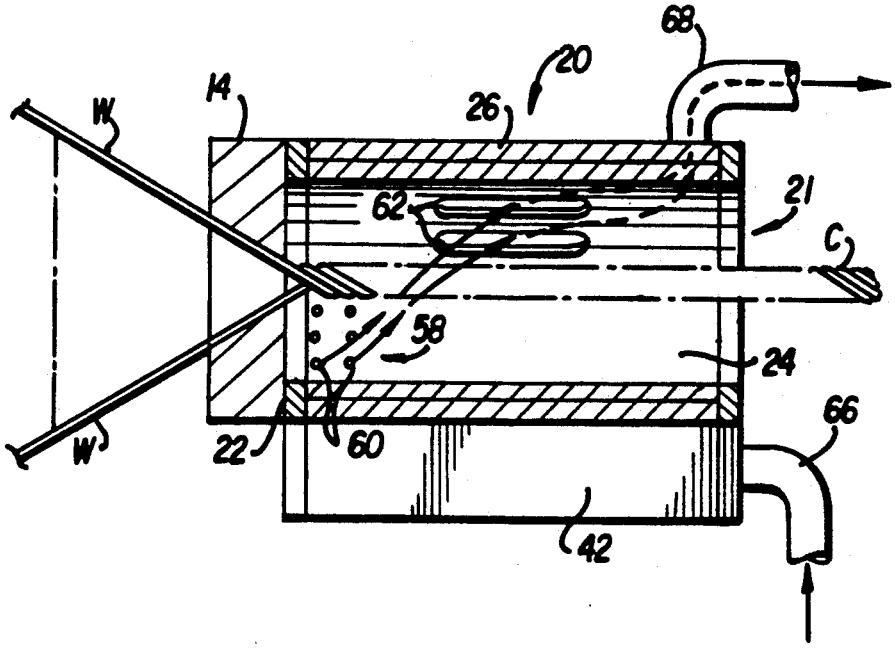
FIG. 6 is a cross-sectional view of the cable cleaning device of the present invention illustrating the operation of the device during manufacture of a stranded cable.

After wires W pass through the stranding head 12 they are converged and consolidated by a stranding die 14, usually made of steel (see FIG. 6). Die 14 is mounted in a die holder 16 and may be fixed in the die holder 16 as shown in FIG. 1 or may be rotatable relative to the die holder. As described thus far, the cable stranding apparatus 10 is conventional.

Located in the die holder 16 downstream of the die 14, but in substantially sealing and abutting relation therewith, is a cable cleaning device or cylinder 20 constructed according to the present invention. The cleaning cylinder 20 is held in place in the die holder 16 by a pair of set screws 18 or any other suitable means that will retain the cylinder 20 in position with its upstream end 22 in abutment with the die 14.

As described hereinafter in more detail in connection with FIGS. 2-6, the cleaning cylinder is provided with piping connections with an air pressure source 13 and a vacuum pump 15, the latter of which discharges into a metal dust collector 17.

Referring now to FIGS. 2-5, the construction of one preferred embodiment the cable cleaning cylinder 20 of the invention will be described. In this embodiment, the cleaning cylinder is conveniently formed by inserting a cylindrical tube 24 into a square tube 26, the latter having inside dimensions equal or nearly equal to the outside diameter of the cylindrical tube 24. This arrangement provides four chambers or plenums 28, 30, 32, 34 of generally triangular cross-section about the cylindrical tube 24 as best seen in FIG. 3. Other constructions of the cable cleaning cylinder will be apparent to those skilled in the art in light of the teachings herein. For example, the four pressure and vacuum chambers could be formed by a pair of concentric tubes with four longitudinally extending radial partitions arranged at 90° intervals between the tubes. Square tubing may also be used.

The upstream and downstream ends of the four chambers 28-34 are closed by plates 36, 38. A pair of elongated manifolds 40, 42 are mounted to the underside of the cleaning cylinder and are in fluid flow communication with vacuum chamber 30 and pressure chamber 34, respectively, via one or more openings 44, 46. Chambers 28, 30 are connected to vacuum source 15 by means of a pipe connected to threaded connection 48 in the top of the cleaning cylinder 20 and a pipe connected to threaded connection 50 in the downstream end of manifold 40. Chambers 32, 34 are connected to pressure source 13 by means of a pipe connected to threaded connection 52 in the top of the cleaning cylinder 20 and a pipe connected to threaded connection 54 in the downstream end of manifold 42.

The vacuum and pressure pipe connections to the cleaning cylinder 20 at threaded pipe connections 48, 50, 52, 54 are arranged to be compatible with a particular cable stranding machine. Those skilled in the art will appreciate that the vacuum and pressure connections may be made in other ways, e.g., by threaded connections in each corner of end plate 36 or by reversing the arrangement of one or both of the manifolds 40, 42 and one or both of the connections 48, 52.

Figure 5:
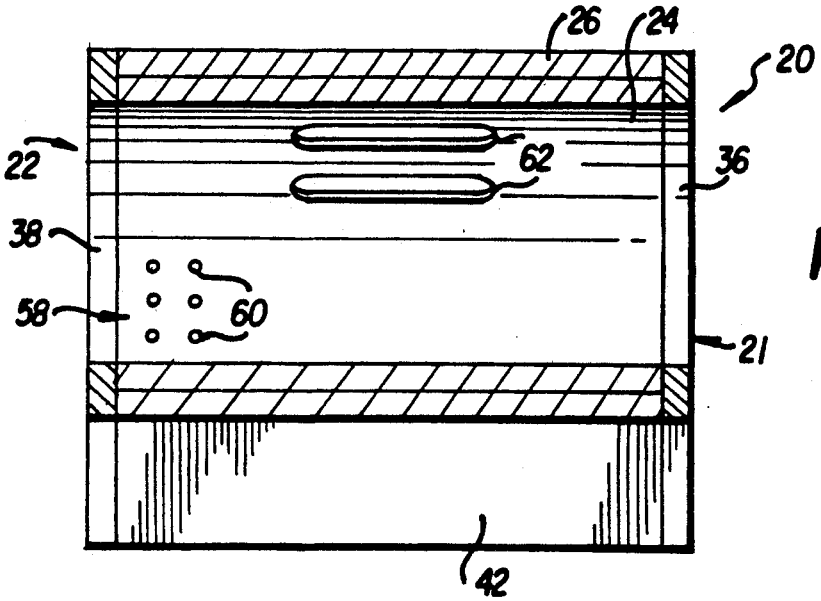
FIG. 5 is a cross-sectional view of the cable cleaning device of the present invention taken along line 5—5 of FIG. 2.

FIGS. 4 and 5 are cross-sectional views of the cleaning cylinder 20 showing the opposite interior cylindrical walls of the tube 24. Located adjacent the upstream end 22 of the cleaning cylinder 20 are two groups 56, 58 of small ports 60. The ports 60 of group 56 (FIG. 4) are in flow communication with pressure chamber 32 and the ports 60 of group 58 (FIG. 5) are in flow communication with pressure chamber 34. Located at the approximate axial midpoint of the cylindrical tube 24 are two pair of elongated slots 62, 64 which are in flow communication with a respective vacuum chamber 28, 32.

Referring now to FIGS. 1 and 6, the operation of the cleaning cylinder 20 will be described. The wires W made, for example, of aluminum or an aluminum alloy pass through the stranding head 12 and are twisted, converged and consolidated in the die 14. The twisting and consolidation of the wires W in the die causes particles of aluminum to break off or shave off from the wires and create small particles or a "dust" of aluminum in the interior of the cleaning cylinder 20. Since the outside diameter of the die 14 is greater than the inside diameter of the tube 24 of the cleaning cylinder 20, the die 14 abuts and substantially seals off the upstream end 22 of the cleaning cylinder and prevents the egress of aluminum dust particles from the upstream end 22. As the twisted cable C travels through the cylinder 20 from left to right as viewed in FIG. 6, pressurized air from source 13 is introduced into the pressure chambers 32, 34 via pipes 66 as previously described and air under pressure flows as air jets from the ports 60 of the two groups 56, 58 of ports (only group 58 shown in FIG. 6). The air jets impinge on the twisted cable C as it exits the die 14 and blow aluminum dust therefrom. It will be understood that there are two groups of jets directed at the cable from diametrically opposite positions. Simultaneously, vacuum source or vacuum pump 15 connected to vacuum chambers 28, 30 via pipes 68 withdraws air and entrained aluminum dust from the interior of the cleaning cylinder via the elongated slots 62, 64 (only slots 62 shown in FIG. 6). Thus, as shown by the arrows in FIG. 6, pressurized air enters pipe 66, passes through manifold 42 into pressure chamber 34, flows out of ports 60 as air jets which impinge upon cable C and entrain any dust particles on the cable C. The air with entrained dust particles then flows through slots 62 into vacuum chamber 28 and pipe 68 by reason of the suction of vacuum pump 15 connected to pipe 68.

Preferably, the volumetric inflow of air from pressurized source 13 into the cylinder 20 is less than the volumetric outflow of air from the vacuum pump 15 so that air surrounding the cleaning cylinder 20 is drawn into the open, downstream end 21 of the cylinder 20 to prevent the egress of any airborne dust particles. Such inflow of air from open end 21 is also shown by arrows in FIG. 6.

In one typical example of the invention, pressurized air at a flow rate of 20 cfm (cubic feet per minute) is introduced into the interior of cylinder 20 via ports 60 and air and dust particles are withdrawn from the interior of the cylinder via slots 62, 64 at a flow rate of 40 cfm. The 20 cfm outflow differential is offset by a 20 cfm inflow of air through the open end 21 of the cylinder. The volumetric air pressure and vacuum flow rates may be adjusted for a particular application, the only requirement being that the flow rates should be great enough to cleanse the cable of any dust particles and prevent the outflow of airborne metal dust.

In another aspect of the invention, the metal dust particles removed from the cable C by cleaning cylinder 20 are recovered in a dust collector 17 from which they may be recycled as scrap. If desired, the dust may be filtered or otherwise treated to remove foreign matter therefrom.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for in-line cleaning during manufacture of stranded cable formed from a plurality of wires comprising:

a cleaning tube defining a passage through which the cable moves longitudinally;

at least one pressure chamber and at least one vacuum chamber connected to said cleaning tube;

a source of pressurized air connected to said pressure chamber;

a source of vacuum connected to said vacuum chamber;

port means communicating said pressure chamber with said cleaning tube for impinging jets of air from the pressurized air source on the cable as it moves along the cleaning tube passage and for entraining dust cleaned from the cable, said entraining occurring directly into air from said jets; and means communicating said vacuum chamber with said cleaning tube for withdrawing air and entrained dust from the cleaning tube.

2. Apparatus according to claim 1, wherein the cable is stranded from a plurality of metal wires and the dust cleaned from the cable comprises particles of metal from the wires.

3. Apparatus according to claim 2, wherein said metal is selected from the group consisting of aluminum, an aluminum alloy, copper and a copper alloy.

4. Apparatus for in-line cleaning of stranded cable formed from a plurality of wires comprising:

a cleaning tube defining a passage through which the cable moves longitudinally, said cleaning tube having an upstream end and a downstream end;

die means located upstream of the cleaning tube for converging and consolidating the wires of the cable, said die means abutting and closing the upstream end of said cleaning tube, said downstream end of the cleaning tube being open;

at least one pressure chamber and at least one vacuum chamber connected to said cleaning tube;

a source of pressurized air connected to said pressure chamber;

a source of vacuum connected to said vacuum chamber;

port means communicating said pressure chamber with said cleaning tube for impinging jets of air from the pressurized air source on the cable as it moves along the cleaning tube passage and for entraining dust cleaned from the cable; and means communicating said vacuum chamber with said cleaning tube for withdrawing air and entrained dust from the cleaning tube.

5. Apparatus according to claim 4, wherein the volumetric flow rate of pressurized air through the port means into the cleaning tube is less than the volumetric flow rate of air and entrained dust withdrawn from the cleaning tube so as to create an inflow of air through the open end of the cleaning tube.

6. Apparatus according to claim 5, wherein the volumetric flow rate of pressurized air is about 20 cfm and the volumetric flow rate of air and entrained dust is about 40 cfm.

7. Apparatus according to claim 1, wherein the volumetric flow rate of pressurized air through the port means into the cleaning tube is less than the volumetric flow rate of air and entrained dust withdrawn from the cleaning tube so as to prevent the egress of dust from the cleaning tube except through said withdrawing means.

8. Apparatus according to claim 1, wherein said cleaning tube comprises a cylindrical tube disposed in a square tube to form between said tubes a pair of oppositely disposed pressure chambers and a pair of oppositely disposed vacuum chambers.

9. Apparatus according to claim 8, wherein said port means comprises a plurality of holes in the wall of the cylindrical tube communicating with the pressure chambers and said withdrawing means comprises a plurality of elongated slots in the wall of the cylindrical tube communicating with the vacuum chambers.

10. Apparatus according to claim 8, including an elongated pressure manifold connected to one of said pressure chambers and an elongated vacuum manifold connected to one of said vacuum chambers, said manifolds comprising a support base for said cleaning tube.

11. Apparatus according to claim 1, wherein said port means are located upstream of said withdrawing means.

12. Apparatus according to claim 1, including means for collecting the dust withdrawn from the cleaning tube.

13. Apparatus for in-line cleaning of stranded cable formed from a plurality of wires comprising:

a cleaning tube defining a passage through which the cable moves longitudinally;

a stranding die and a dies holder, said die holder supporting said cleaning tube in abutting substantially sealing relation with said stranding die;

at least one pressure chamber and at least one vacuum chamber connected to said cleaning tube;

a source of pressurized air connected to said pressure chamber;

a source of vacuum connected to said vacuum chamber;

port means communicating said pressure chamber with said cleaning tube for impinging jets of air from the pressurized air source on the cable as it moves along the cleaning tube passage and for entraining dust cleaned from the cable; and means communicating said vacuum chamber with said cleaning tube for withdrawing air and entrained dust from the cleaning tube.

14. Apparatus for in-line cleaning during manufacture of stranded cable formed from a plurality of wires comprising:

a cleaning tube defining a passage through which the cable moves longitudinally;

art least one pressure chamber and at least one vacuum chamber connected to said cleaning tube;

a source of pressurized air connected of said pressure chamber;

a source of vacuum connected to said vacuum chamber;

port means communicating said pressure chamber with said cleaning tube for impinging jets of air from the pressurized air source on the cable as it moves through the cleaning tube passage and for entraining dust cleaned from the cable, said entraining occurring directly into air from said jets; and means communicating said vacuum chamber with said cleaning tube for withdrawing air and entrained dust from the cleaning tube, the volumetric flow rated of air and entrained dust withdrawn from said cleaning tube passage being greater than the volumetric flow rate of pressurized air through the port means.

15. Apparatus according to claim 14, wherein the volumetric flow rate of air and entrained dust is about twice the volumetric flow rate of pressurized air.

16. Apparatus for in-line cleaning during manufacture of stranded cable formed from a plurality of wires comprising:

a cleaning tube having a passage through which the cable moves longitudinally;

at least one pressure chamber and at least one vacuum chamber connected to said cleaning tube;

a source of pressurized air connected to said pressure chamber;

a source of vacuum connected to said vacuum chamber;

port means communicating said pressure chamber with said cleaning tube for impinging jets of air from the pressurized air source on the cable as it moves through the cleaning tube passage and for entraining dust cleaned from the cable, said entraining occurring directly into air from said jets; and means communicating said vacuum chamber with said cleaning tube for withdrawing air and entrained dust from the cleaning tube, said withdrawing means being located downstream of the port means.

17. Apparatus for in-line cleaning of stranded cable formed from a plurality of wires comprising:

a cleaning tube having a passage through which the cable moves longitudinally, said cleaning tube having upstream and downstream ends;

at least one pressure chamber and at least one vacuum chamber connected to said cleaning tube;

a source of pressurized air connected to said pressure chamber;

a source of vacuum connected to said vacuum chamber;

port means communicating said pressure chamber with said cleaning tube for impinging jets of air from the pressurized air source on the cable as it moves through the cleaning tube passage and for entraining dust cleaned from the cable;

means communicating said vacuum chamber with said cleaning tube for withdrawing air and entrained dust from the cleaning tube; and die means abutting and closing the upstream end of said cleaning tube for converging and consolidating the wires of the cable, said downstream end of said cleaning tube having an opening through which the cable moves, said opening having a cross-sectional substantially area greater than the cross-sectional area of the cable.

* * * * *